United States Patent [19]

Honsel

[11] 4,223,596

[45] Sep. 23, 1980

[54] APPARATUS FOR CONVERTING BLANKS INTO ENVELOPES

[76] Inventor: Karl-Heinz Honsel, Heidelberger Weg 15, D-4800 Bielefeld 1, Fed. Rep. of Germany

[21] Appl. No.: 963,295

[22] Filed: Nov. 24, 1978

[30] Foreign Application Priority Data

Nov. 14, 1977 [DE] Fed. Rep. of Germany ..... 2752411

[51] Int. Cl.[3] ..... B31B 1/56

[52] U.S. Cl. ..... 93/62; 93/84 R

[58] Field of Search ..... 93/61 R, 62, 84 R

[56] References Cited

U.S. PATENT DOCUMENTS

| | | | |
|---|---|---|---|
| 1,713,243 | 5/1929 | Swab | 93/62 |
| 3,793,926 | 2/1974 | Honsel | 93/62 |
| 3,837,266 | 9/1974 | Honsel | 93/84 R X |

*Primary Examiner*—Robert D. Baldwin
*Attorney, Agent, or Firm*—Peter K. Kontler

[57] ABSTRACT

Apparatus for converting successive prefabricated blanks into envelopes has a pair of shiftable advancing rolls which transport successive blanks into the nip of two rotary cylindrical holders one of which supports a first folding tool and the other of which supports a first tongs. The tool cooperates with the tongs to fold one major panel of the blank over the other major panel, and such folding is assisted by a suitable guide which is adjacent to the path of movement of successive blanks downstream of the holders. Successive blanks are thereupon engaged and entrained by an orbiting suction head which transports the blanks into the range of a second folding tool cooperating with a second tongs to fold one flap of one of the major panels over the adjacent portion of the other major panel. The suction head is mounted on a rotary cylindrical holder which further carries the second folding tool. The flap which is folded by the second tool and second tongs is coated with adhesive during transport between the first and second folding tools. A transfer conveyor thereupon transports successive blanks past a second paster which applies adhesive to another flap of the one major panel before the second flap is folded over the other major panel.

9 Claims, 4 Drawing Figures

APPARATUS FOR CONVERTING BLANKS INTO ENVELOPES

BACKGROUND OF THE INVENTION

The present invention relates to apparatus for converting blanks which consist of paper or the like into envelopes, e.g., into envelopes which can be used for shipment, storage or mailing of correspondence or other material.

Many presently known envelope making machines operate in such a way that a web of foldable material is caused to pass through a stamping or punching unit wherein a reciprocable punch removes discrete blanks from successive sections of the moving web. The blanks are thereupon stacked in a magazine and are withdrawn seriatim to advance through a folding apparatus which converts each blank into a discrete envelope. The folding apparatus further comprises suitable paster means for applying one or more layers of adhesive to one or more selected portions of each blank. It is also known to transport discrete blanks from the stamping or punching station directly to the folding apparatus.

In heretofore known folding apparatus, a blank moves lengthwise and is scored by suitable rollers which form fold lines between the two major panels as well as between a major panel and at least one lateral flap. The thus treated blank is transported past loop-shaped guides which consist of sheet metal or the like and fold the blank along the scored fold line between the two major panels. Thus, the blank is converted into a partly finished envelope wherein the two major panels overlie each other. The folding of one flap of the envelope is carried out by advancing the partially finished envelope into the range of an upsetting device which consists of sheet metal or the like and folds the one flap subsequent to movement of such flap along a paster which applies to one of its sides a layer of suitable adhesive. The upsetting device folds the one flap and presses it against the outer side of the adjacent major panel. The same procedure is followed for folding of the other flap or flaps of the blank, i.e., such other flap or flaps are coated with adhesive and each adhesive-coated flap is moved past a discrete upsetting device which folds the respective flap over and presses it against the outer side of the adjacent major panel. A further stage of processing involves the application of adhesive to the closing flap or lid, i.e., to that flap which is folded over and adhesively secured to the adjacent panel subsequent to introduction of the material to be shipped, stored or mailed into the interior of the envelope.

A drawback of the just described folding apparatus is that they are quite long and bulky. The main reason for bulkiness of conventional folding apparatus is the presence of aforediscussed loop-shaped folding means which causes one of the major panels to overlie the other major panel. Moreover, the blanks are advanced and held exclusively by belts which are incapable of insuring accurate retention of successive blanks in identical positions, i.e., the dimensions of envelopes often deviate from the desired norm. The deviations from norm are especially pronounced when the envelopes are made of lightweight (thin and porous) paper sheet stock.

OBJECTS AND SUMMARY OF THE INVENTION

An object of the invention is to provide a compact and simple but highly reliable apparatus for conversion of blanks which are made of paper or the like into envelopes or analogous receptacles.

Another object of the invention is to provide a folding apparatus which can treat and otherwise manipulate lightweight blanks with the same degree of reproducibility as those blanks which consist of heavier paper stock or other foldable sheet material.

A further object of the invention is to provide an apparatus which can fold the two major panels of a blank over each other in a small area and which can also fold one or more flaps of the blank during continuous transport of blanks in a manner such that each and every blank of a long series of such commodities is guided along the same path and is oriented in the same way as each preceding blank.

An additional object of the invention is to provide the folding apparatus with novel and improved means for transporting successive blanks and partly finished as well as completed envelopes toward, past and beyond numerous folding and/or other processing instrumentalities.

Another object of the invention is to provide the apparatus with novel and improved means for moving successive blanks along successive portions of a predetermined path during folding and/or scoring of and/or during application of adhesive to selected parts of such blanks.

The invention is embodied in an apparatus for converting plastic blanks, paper blanks, lightweight cardboard blanks or analogous blanks of the type having first and second major panels and at least two flaps extending from different sides of one major panel into envelopes. The apparatus comprises means (e.g., two shiftable advancing rolls) for transporting a series of successive blanks into a first portion of a predetermined path wherein the first panel constitutes the leader of the respective blank, a first folding unit which is adjacent to the first portion of the path and comprises a moving (preferably orbiting) first folding tool at one side and a moving (preferably orbiting) first tongs at the other side of the path to cooperate with the folding tool so as to fold the first panel over the second panel of the blank which is located in the first portion of the path and to advance the blank into a second portion of the path, guide means (e.g., a suitably oriented and configurated plate made of sheet metal or the like) adjacent to the second portion of the path and arranged to promote folding of the first major panel over the second major panel of each of the aforementioned series of blanks, a moving (preferably orbiting) suction head adjacent to a third portion of the path downstream of the second portion and serving to accept successive blanks from the first tongs, to engage such blanks and to advance the blanks toward and into a fourth portion of the path, and a second folding unit adjacent to the fourth portion and including a second moving (preferably orbiting) folding tool at one side and a second moving (preferably orbiting) tongs at the other side of the path to cooperate with the second tool so as to fold one of the flaps over the adjacent major panel of the respective blank.

As mentioned above, the tongs are preferably arranged to orbit adjacent to the respective portions of the path; to this end, the apparatus can comprise substantially cylindrical rotary holders for the tongs. It is further preferred to provide a common rotary cylindrical holder for the suction head and the second folding tool, and to provide means for adjustably securing the suction head and/or the second folding tool to the respective holder. The second folding unit is preferably disposed below and is preferably laterally offset with respect to the first folding unit.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
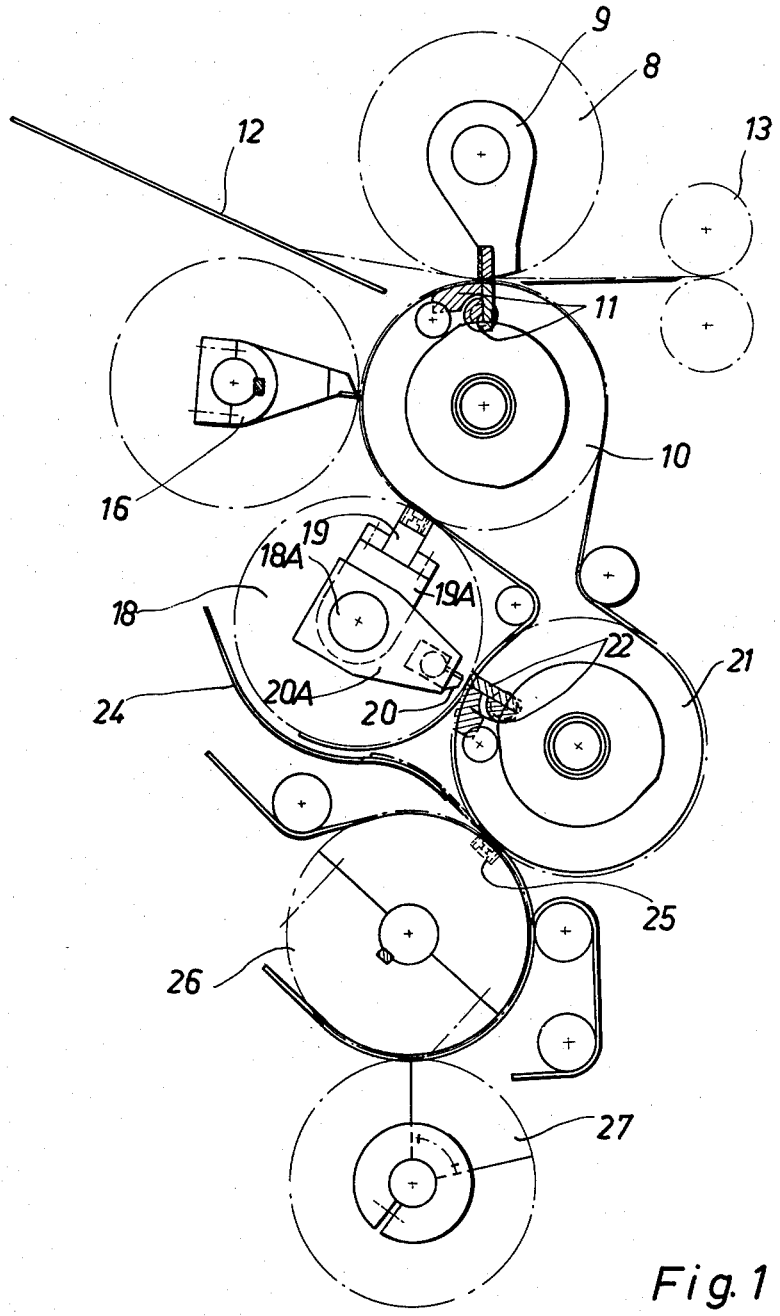
FIG. 1 is a somewhat schematic partly side elevational and partly sectional view of an apparatus which embodies one form of the invention.
Figure 2:
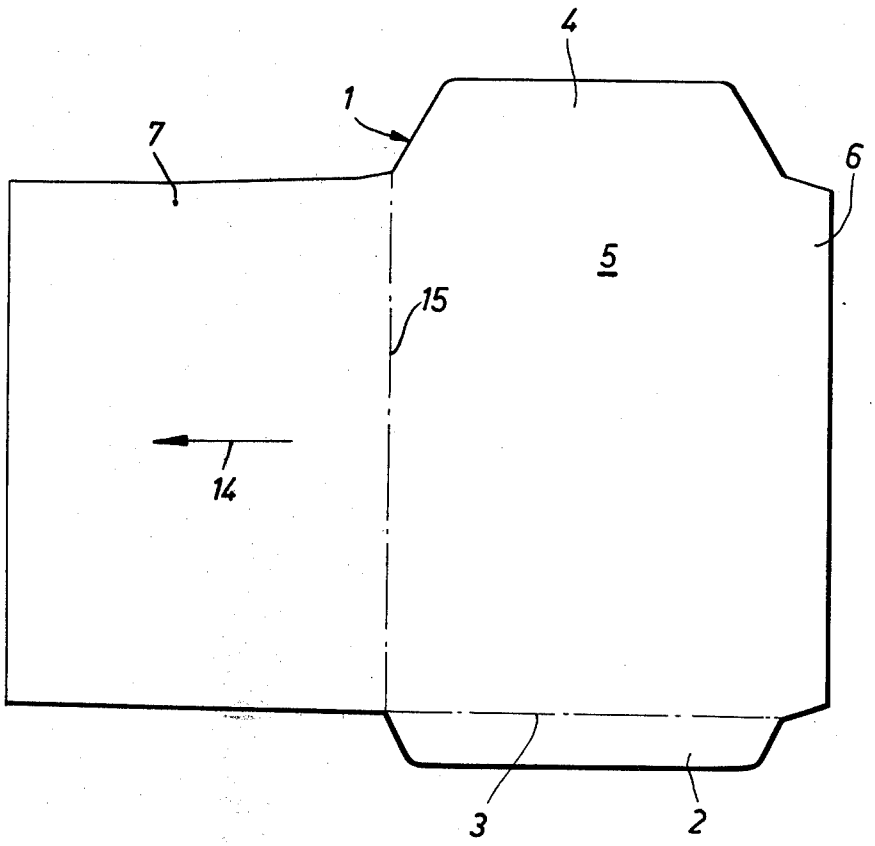
FIG. 2 is a plan view of a blank which can be treated in the apparatus of FIG. 1.

Referring to the drawing in detail, the improved apparatus is designed to make envelopes by appropriate manipulation of blanks 1 of the type shown in FIG. 2. Such blanks are obtained by drawing a web of sheet material (e.g., paper) from a bobbin or roll (not shown) having a width which matches or exceeds the maximum width of a blank 1. In a first step, the web is provided with transversely extending scored fold lines 15 (the fold line 15 for the blank 1 of FIG. 2 is indicated by a phantom line) along which the blanks are folded in the improved apparatus so as to place the two major panels 5 and 7 into positions of overlap with each other (see FIG. 3). At the same time or prior or subsequent to such scoring, the web is subjected to the action of rotating cutting implements (not shown) which subdivide the web into a series of discrete sections each having a length corresponding to the length of a discrete blank 1. The sections are further subjected to the action of rotating severing instrumentalities which trim the sections in the longitudinal direction of the web so as to provide each blank 1 with a short lateral flap 2, a long flap 6, and a closing flap or lid 4. At the same time, the just mentioned instrumentalities trim the marginal portions of the major panel 7 so that the width of this panel equals or approximates the distance between the flaps 2, 4 and equals the maximum length of the flap 6. Successive finished blanks 1 are thereupon introduced into the nip of two shiftable advancing rolls 13 (indicated in FIG. 1 by phantom lines) which transport successive blanks in the direction indicated by an arrow 14 which is shown in FIG. 2. In other words, the major flap 7 constitutes the leader of each blank 1 and the long flap 6 is located at the trailing end of the blank 1. It will be noted that the scored fold line 15 of a blank 1 which is transported by the advancing rolls 13 is parallel to the axes of such rolls. It is further desirable to provide each blank 1 with a scored fold line 3 which is parallel to the direction indicated by arrow 14 and is disposed between the major panel 5 and flap 2. The blank 1 which is engaged by the rolls 13 is transported in such a way that the shorter flaps 2 and 4 extend laterally from the major panel 5 which is located behind the major panel 17 and in front of the long flap 6.

Figure 3:
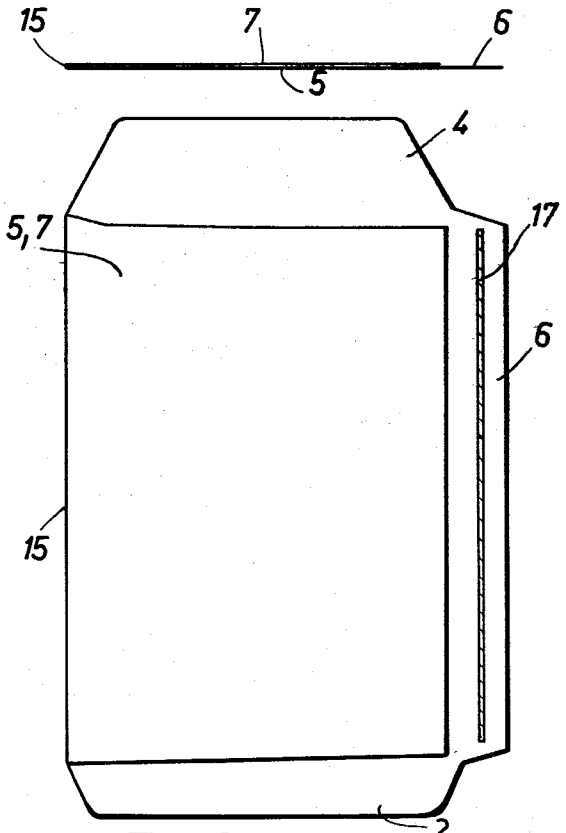
FIG. 3 shows a partly converted blank in two different views.

The apparatus of FIG. 1 further comprises a rotary cylindrical holder 8 (indicated by phantom lines) for a knife-like first folding tool 9. The latter cooperates with a complementary folding tool 11 which constitutes a tongs and is mounted on a second rotary cylindrical holder 10 disposed at a level below the holder 8. The tools 9 and 11 constitute a first folding unit and cooperate to fold a blank 1 along the line 15 when the line 15 is located in the nip of the holders 8 and 10. At least one jaw of the tool 11 is movable with respect to the other jaw by one or more cams (not specifically shown) so that the knife-like tool 9 can introduce a portion of the blank 1 in the region of the fold line 15 between the jaws of the tool 11 whereupon the latter closes to transport the partially completed envelope (wherein the major panels 5 and 7 overlie each other) into the range of an orbiting paster 16 serving to apply an elongated narrow layer 17 of adhesive to one side of the flap 6 (see FIG. 3). A partially folded blank 1 which advances through the nip of the holders 8 and 10 is caused to move its major panel 7 against a guide member 12 which consists of sheet metal or another suitable material and serves to promote folding of the major panel 7 over the other major panel 5. The flap 6 of the blank 1 between the holders 8 and 10 moves beyond the advancing rolls 13 when the scored fold line 15 reaches the knife-like folding tool 9 on the holder 8. From there on, the partially deformed blank 1 is held by the jaws of the tool 11 because the aforementioned cam or cams cause the movable jaw of the tool 11 to move toward the other jaw so that the blank 1 is pinched by the jaws in the region of the scored fold line 15. While the blank 1 advances with the tool 11 of the holder 10, the guide 12 folds the major flap 7 over the major flap 5 so that, after the blank advances beyond the paster 16, it assumes a shape which is shown in FIG. 3, i.e., the panels 5 and 7 overlie each other, the flap 6 is provided with a layer 17 of adhesive paste, and the flaps 2 and 4 extend laterally from the panel 5. The paster 16 is orbited in synchronism with movements of the holders 8 and 10 so that it applies a layer 17 of adhesive (e.g., a hotmelt or a wet adhesive) to each of a series of successive flaps 6.

The apparatus further comprises a third rotary cylindrical holder 18 which is offset with respect to the holder 10 (it is mounted at the seven o'clock position of the holder 10) and supports an orbiting knife-like second folding tool 20 as well as an elongated strip-shaped suction head 19. The tool 20 and the suction head 19 extend in parallelism with the axis of the holder 18. The arrangement is preferably such that the tool 20 is adjustable with respect to the suction head 19 (and/or vice versa), as considered in the circumferential direction of the holder 18. All that is necessary is to loosen the arm 19A for the suction head 19 and/or the arm 20A for the tool 20 and to change the angular position of the loosened arm 19A or 10A with respect to the shaft 18A for the holder 18.

The knife-like folding tool 20 on the holder 18 cooperates with a complementary folding tool 22 in the form of a second tongs mounted on a rotary cylindrical holder 21. At least one jaw of the tool 22 is movable toward and away from the other jaw of the tool 22 by an actuating system including one or more cams (not specifically shown) so as to enable the tool 20 to introduce a portion of a partly deformed blank 1 between the jaws when the tool 22 is maintained in open position. The holder 21 is offset with respect to the holder 18; it is located at the four o'clock position of the endless path of orbital movement of the suction head 19 and folding tool 20.

Figure 4:
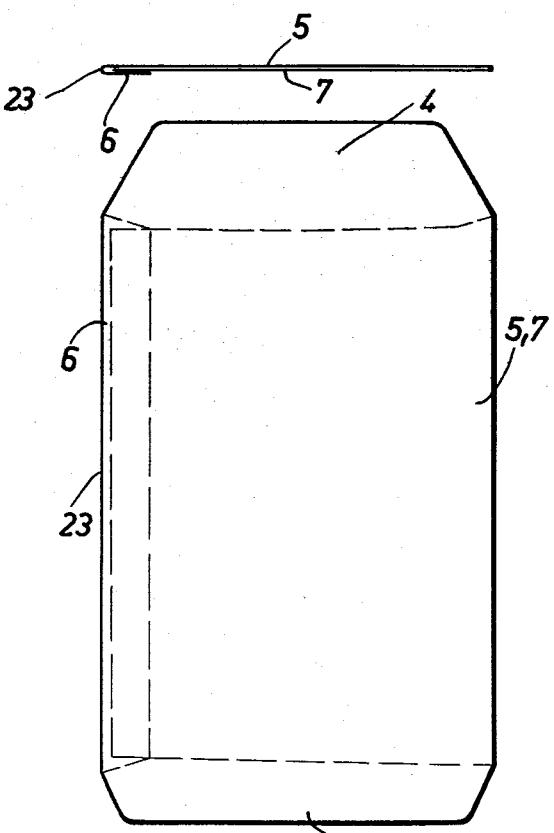
FIG. 4 shows two different views of a blank during a further stage of conversion into an envelope.

The purpose of the suction head 19 is to attract a partly deformed blank 1 (such blank is then in the condition which is shown in FIG. 3) and to advance the blank along the path portion which is defined by the holder 18. The jaws of the tool 11 open when the blank 1 moves into the range of the suction head 19 so that the blank becomes separated from the holder 10. The feature that the holder 18 is offset with respect to the holder 10 renders it possible to advance a blank 1 which has been released by the tool 11 in a direction tangentially of the holder 10. The suction head 19 releases the blank 1 (i.e., its suction port or ports are sealed from the associated suction generating device, not shown) when the blank 1 moves between the folding tools 20 and 22. These tools cooperate to fold the blank 1 along the line 23, i.e., to fold the flap 6 over the adjacent marginal portion of the major panel 17 which already overlies the major panel 5. This is shown in FIG. 4. The blank 1 (which has been converted into a partly finished envelope having the shape shown in FIG. 4) is then held and advanced by the tool 22, i.e., it shares the movement of the holder 21. As mentioned above, the suction head 19 releases the blank 1 as soon as the latter is engaged by the tools 20 and 22.

The holder 18 for the tool 20 and suction head 19 advances successive partly deformed blanks 1 past a substantially S-shaped guide element 24 which consists of sheet metal or the like and along which the (then) trailing portion (region of the fold line 15) of the partly deformed blank advances while moving with the tool 22 on the holder 21.

The holder 21 delivers successive blanks 1 (having the shape shown in FIG. 4) to a rotary cylindrical transfer conveyor 26 which carries an elongated strip-shaped suction head 25 for further transport of the blanks 1 through the apparatus. The suction head 25 attracts and advances a blank 1 as soon as the latter is released by the jaws of the tool 22, and the blank 1 is then transported along a second paster 27 which applies a layer of adhesive to the short flap 2 before the latter is folded over the major panel 7 by moving along a suitable folding instrumentality such as a short guide (not shown) which is made of sheet metal or the like. The just mentioned guide folds the flap 2 along the scored fold line 3 shown in FIGS. 2 and 4.

The folding apparatus of FIG. 1 can be readily modified to form envelopes from blanks wherein the sealing or closing flap or lid 4 is adjacent to a longer side of the major panel 5, i.e., wherein the positions of flaps 4 and 6 are interchanged. A blank wherein the lid is located at the trailing end (as considered in the direction of arrow 14 shown in FIG. 2) is transported through the apparatus in the same way as described in connection with the blank 1. The paster 27 is removed or deactivated if the lid at the trailing end of the just discussed modified blank should not be provided with a layer of adhesive. The paster 16 is then replaced with a twin paster which can apply layers of adhesive to the lateral flaps of the major panel 5. In accordance with heretofore known techniques, the making of envelopes with lids extending along the shorter and longer sides of a major panel had to be carried out by resorting to two discrete folding apparatus. In other words, the improved apparatus is sufficiently versatile to make substantially rectangular envelopes with closing flaps or lids adjacent to a longer or shorter side of the corresponding major panel.

An important advantage of the improved apparatus is that the blanks are transported by a series of rotating or orbiting devices which occupy much less room than the belts of conventional apparatus. The space requirements of each of the two folding units 9, 11 and 20, 22 are a small fraction of space requirements of corresponding components in conventional apparatus. Moreover, the transporting elements 13, 11, 19, 22 and 25 of the improved apparatus insure that each and every blank of a long series of successive blanks is transported along the same path so that the configuration of each finished envelope matches the optimum configuration. Each and every blank is positively held during each stage of transport along the aforementioned path which extends from the nip of the advancing rolls 13, between the holder 8, 10, along the paster 16 and suction head 19, between the holders 18, 21, along the suction head 25 and along the paster 27.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for converting blanks of the type each having a first and a second major panel, the latter having at least two flaps extending from different sides thereof, into envelopes, comprising means for transporting a series of the blanks in succession into a first portion of a predetermined path wherein said first panel constitutes the leader of the respective blank; a first folding unit adjacent to said first path portion and comprising and orbiting first folding tool at one side and an orbiting first tongs at the other side of said path, said tool and said tongs cooperating to fold said first panel over said second panel of the respective blank in said first portion and to advance such folded blank with the fold at the leading end and with one of said flaps at the trailing end thereof into a second portion of said path; guide means adjacent to said second path portion and arranged to support said first panel prior to and during the folding thereof over said second panel; an orbiting suction head adjacent to a third portion of said path downstream of said second portion and arranged to engage the respective blank at the leading end zone thereof and to advance the same in said third path portion and said one fold toward a fourth portion of said path; a second folding unit adjacent to said fourth portion and including a second folding tool orbiting with said suction head at one side of said path and a second orbiting tongs at the other side of said path, said second tool and said second tongs cooperating to fold said first panel of the respective blank over said one flap during a retraction of the respective blank by said second folding tool from said third path portion with said one flap ahead; and additional guide means extending toward said second folding tool and along said third path portion and supporting the respective blank in said third path portion at least during the retraction thereof.

2. The apparatus of claim 1, further comprising first and second rotary holder means for said first and said second tongs, respectively.

3. The apparatus of claim 1, further comprising common rotary holder means for said suction head and said second folding tool.

4. The apparatus of claim 3, wherein said second folding unit is disposed at a level below and is laterally offset with respect to said first folding unit.

5. The apparatus of claim 1, wherein said transporting means comprises shiftable advancing rolls.

6. The apparatus of claim 1, further comprising a second suction head adjacent to a fifth portion of said path downstream of said fourth portion and conveyor means for orbiting said second suction head about a predetermined axis.

7. The apparatus of claim 6, wherein said conveyor means is a rotary cylindrical conveyor.

8. The apparatus of claim 1, further comprising a common rotary holder for said suction head and said second folding tool and means for adjustably securing at least one of the components including said suction head and said second tool to said holder.

9. The apparatus of claim 1, wherein said first folding tool, said first tongs and said guide means are located at a level above said second tool, said suction head and said second tongs.

* * * * *

UNITED STATES PATENT AND TRADEMARK OFFICE

CERTIFICATE OF CORRECTION

PATENT NO. : 4,223,596

DATED : September 23, 1980

INVENTOR(S) : Karl-Heinz HONSEL

It is certified that error appears in the above-identified patent and that said Letters Patent are hereby corrected as shown below:

Foremost Page, left-hand column, Item [30]
"November 14, 1977" should read --November 24, 1977--.

Signed and Sealed this

*Twenty-third* Day of *December 1980*

[SEAL]

*Attest:*

SIDNEY A. DIAMOND

*Attesting Officer*

*Commissioner of Patents and Trademarks*